US009022605B2

(12) United States Patent
Bushnell et al.

(10) Patent No.: US 9,022,605 B2
(45) Date of Patent: May 5, 2015

(54) CHARGING CONNECTION DEVICE WITH ILLUMINATION AND ASSOCIATED METHODS

(75) Inventors: Irving Edward Bushnell, Melbourne, FL (US); Marcelo Blalock, Melbourne, FL (US)

(73) Assignees: Irving E. Bushnell, Melbourne, FL (US); Marcelo D. Blalock, Melbourne, FL (US)

( * ) Notice: Subject to any disclaimer, the term of this patent is extended or adjusted under 35 U.S.C. 154(b) by 188 days.

(21) Appl. No.: 13/606,423

(22) Filed: Sep. 7, 2012

(65) Prior Publication Data

US 2013/0065444 A1 Mar. 14, 2013

Related U.S. Application Data

(60) Provisional application No. 61/532,239, filed on Sep. 8, 2011.

(51) Int. Cl.

| | |
|---|---|
| ***F21V 21/00*** | (2006.01) |
| ***H01R 13/631*** | (2006.01) |
| ***H01R 13/70*** | (2006.01) |
| ***H01R 13/717*** | (2006.01) |
| *H01R 31/06* | (2006.01) |

(52) U.S. Cl.

CPC ..... *H01R 13/631* (2013.01); *H01R 13/701* (2013.01); *H01R 13/7175* (2013.01); *H01R 31/065* (2013.01)

(58) Field of Classification Search

CPC ..... H01R 13/701; H01R 13/7175; H01R 31/065; H01R 13/631

USPC ..... 362/276, 249.02, 157, 253, 183; 320/107, 115; 439/620.22

See application file for complete search history.

(56) References Cited

U.S. PATENT DOCUMENTS

| | | | |
|---|---|---|---|
| 1,955,418 | A | 4/1934 | Folen |
| 2,474,407 | A | 6/1949 | Todd et al. |
| 2,612,597 | A | 9/1952 | Sherrard |
| 3,500,293 | A | 3/1970 | Cocco |
| 3,733,576 | A | 5/1973 | Cooper |
| 4,276,582 | A | 6/1981 | Burnett |
| 4,350,407 | A | 9/1982 | Tong |
| 4,584,519 | A | 4/1986 | Gruodis |
| 4,949,035 | A | 8/1990 | Palmer |
| 5,166,482 | A | 11/1992 | Li |
| 5,205,637 | A | 4/1993 | Caspari |
| 5,863,364 | A | 1/1999 | Lin et al. |
| 6,053,765 | A | 4/2000 | Eakins |
| 6,109,760 | A | 8/2000 | Salatrik et al. |
| 6,234,651 | B1 | 5/2001 | Kodama et al. |
| 6,254,426 | B1 | 7/2001 | Lacovelli et al. |

(Continued)

*Primary Examiner* — Stephen F Husar

(57) ABSTRACT

A charging connection device includes a device connector configured to be coupled to a rechargeable electronic device, and a circuit board coupled to the connector and including charging circuitry and an associated light source, such as a light emitting diode (LED), thereon. A housing encloses the circuit board and includes a first end comprising a lens, with the connector extending from the first end. A touch switch, such as touch plates, is on the housing, coupled to the circuit board, and configured to activate the light source. A power source connector is coupled to the circuit board and associated with a second end of the housing. One of the touch plates and/or one side of the housing may include at least one opening therein to transmit light from the light source and indicate right-side-up.

18 Claims, 4 Drawing Sheets

(56) References Cited

U.S. PATENT DOCUMENTS

| | | | |
|---|---|---|---|
| 6,290,533 | B1 | 9/2001 | Major |
| 6,336,825 | B1 | 1/2002 | Seefried |
| 6,361,357 | B1 | 3/2002 | Stillwell et al. |
| 6,388,345 | B1 | 5/2002 | Stimpson |
| 6,547,411 | B1 | 4/2003 | Dornbusch |
| 6,626,703 | B2 | 9/2003 | Hsin |
| 6,638,101 | B1 | 10/2003 | Botelho |
| 6,663,417 | B1 | 12/2003 | Hung |
| 6,733,333 | B1 | 5/2004 | Chen |
| 6,827,462 | B2 | 12/2004 | Wangenhei et al. |
| 6,857,760 | B2 | 2/2005 | Chien |
| 6,874,907 | B2 | 4/2005 | Liao |
| 6,896,544 | B1 | 5/2005 | Kuelbs et al. |
| 6,908,333 | B2 | 6/2005 | Larson |
| 6,921,284 | B2 | 7/2005 | Sirichai et al. |
| 6,969,273 | B2 | 11/2005 | Chen |
| 6,979,223 | B2 | 12/2005 | Chen |
| 7,004,595 | B1 | 2/2006 | Stoddard |
| 7,393,237 | B2 | 7/2008 | Kuo |
| 7,490,958 | B1 | 2/2009 | Stoddard |
| 7,654,858 | B2 | 2/2010 | Geiger |
| 7,661,983 | B2 | 2/2010 | Yang et al. |
| 7,726,825 | B2 | 6/2010 | Mandapat et al. |
| 7,744,231 | B2 | 6/2010 | Hutchinson et al. |
| 7,758,369 | B2 | 7/2010 | Miller et al. |
| 7,893,845 | B2 | 2/2011 | Ritzau |
| 7,976,336 | B2 | 7/2011 | Yang et al. |
| 8,105,106 | B1 | 1/2012 | Stoddard |
| 2003/0100218 | A1 | 5/2003 | Tsai et al. |
| 2003/0194906 | A1 | 10/2003 | Arkin et al. |
| 2004/0219824 | A1 | 11/2004 | Conn |
| 2005/0032554 | A1 | 2/2005 | Yang |
| 2005/0101180 | A1 | 5/2005 | Sirichai et al. |
| 2005/0124209 | A1 | 6/2005 | Currie et al. |
| 2005/0231941 | A1 | 10/2005 | Huang |
| 2005/0266723 | A1 | 12/2005 | Graham et al. |
| 2006/0039136 | A1 | 2/2006 | Probasco et al. |
| 2006/0099999 | A1 | 5/2006 | Park |
| 2006/0250787 | A1 | 11/2006 | Ho et al. |
| 2007/0117450 | A1 | 5/2007 | Truxes |
| 2007/0268688 | A1 | 11/2007 | Chen |
| 2009/0002977 | A1 | 1/2009 | Arnold |
| 2009/0247002 | A1 | 10/2009 | Wu et al. |
| 2011/0065321 | A1 | 3/2011 | Wang |
| 2012/0155064 | A1* | 6/2012 | Waters ..... 362/103 |
| 2013/0265747 | A1* | 10/2013 | Liu ..... 362/157 |

* cited by examiner

CHARGING CONNECTION DEVICE WITH ILLUMINATION AND ASSOCIATED METHODS

RELATED APPLICATION

This application is based upon prior filed provisional application Ser. No. 61/532,239 filed Sep. 8, 2011, the entire subject matter of which is incorporated herein by reference in its entirety.

FIELD OF THE INVENTION

The present invention relates to the field of portable electronics and, more particularly, to charging connection devices for portable electronics such as mobile wireless communication devices and related methods.

BACKGROUND OF THE INVENTION

With the number of mobile devices in use, and their ever increasing capabilities, charging and syncing has become an everyday task for millions of people around the world. The batteries in most modern devices, if used regularly, are typically dead by the end of the day, and many need repetitive charging throughout the day. Many users keep the charger cable in their bedroom for easy access at night, as well as in their vehicles to charge while driving.

The problem arises when the user tries to plug in their device in a dim/dark environment like a dark bedroom or in a vehicle at night. The charging port is typically recessed into the phone and trying to find it by touch alone is difficult. In addition, the connectors will only plug in when inserted right-side up.

U.S. Patent Application Publication 2005/0032554 to Yang is directed to a cellular phone car charger with an illuminating function comprising a power connection plug, a conductive cable, a charge connector and an illuminating device. The power connection plug is connected to a power socket within a car for providing a charging power source. However, the illuminating device uses the charging power to illuminate surrounding areas, and the on or off state of the illuminating device is controlled by a mechanical switch.

U.S. Patent Application Publication 2003/0194906 to Arkin et al. is directed to a lighted accessory connector that includes a first end connected to a conductor cable and configured for connection to a voltage source, and a second opposite end connected to the conductor cable and configured for connection to an electrical device. A light source automatically illuminates upon connection of the first end to the voltage source and cannot be selectively switched on/off.

Conventional approaches, such as those described above, may not directed light toward the charging port of the phone or may include automatic illumination when the connector is plugged into the power source. Furthermore, such conventional connectors may also be difficult to determine right-side up in the dark.

SUMMARY OF THE INVENTION

In view of the foregoing background, it is therefore an object of the present invention to provide a straightforward intuitive charging connection device with an illumination feature providing the right amount of light to find the mobile device's charger port.

This and other objects, features, and advantages in accordance with the present invention are provided by a charging connection device comprising a device connector configured to be coupled to a rechargeable electronic device, and a circuit board coupled to the connector and including charging circuitry and an associated light source, such as a light emitting diode (LED), thereon. A housing encloses the circuit board and includes a first end comprising a lens, with the connector extending from the first end. Touch plates are on opposite sides of the housing, coupled to the circuit board, and configured to activate the light source. A power source connector is coupled to the circuit board and associated with a second end of the housing.

One of the touch plates and/or one side of the housing may include at least one opening therein to transmit light from the light source and indicate right-side-up. An adhesive may secure the touch plates and the housing. The power source connector may comprise a female connector configured to receive a power charging cable. A charging cable, such as a Universal Serial Bus (USB) cable, may couple the power source connector to the circuit board.

A method aspect of the present embodiments is directed to a method of making a charging connection device. The method includes coupling a device connector, configured to be coupled to a rechargeable electronic device, to a circuit board that includes charging circuitry and an associated light source thereon. The method also includes: enclosing the circuit board with a housing that includes a first end comprising a lens, the device connector extending from the first end of the housing; providing touch plates on opposite sides of the housing and coupled to the circuit board, and configured to activate the light source; and coupling a power source connector to the circuit board and associated with a second end of the housing.

The present embodiments provide directed illumination while the user is trying to charge or sync their mobile device, which makes plugging it in, while in the dark, much easier. To provide an uncomplicated intuitive product for the customer, the illumination is activated when the touch plates are touched. In essence, the user does not need to think about activating the illumination. They grab the end of the cable, and it lights up, providing the right amount of light to find the device's charger port and at the same time, know that the connector is right side up.

DETAILED DESCRIPTION OF THE PREFERRED EMBODIMENTS

Figure 1:
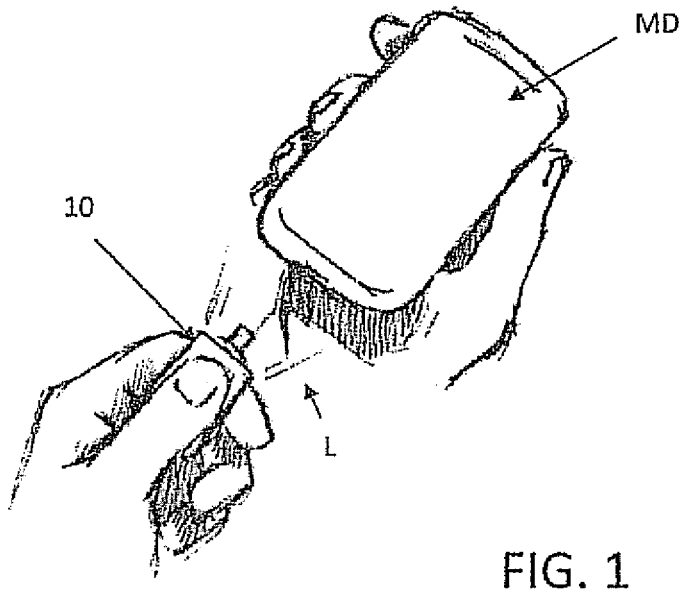
FIG. 1 is a top view illustrating the charging connection device being operated in relation to an associated mobile device in accordance with features of the present embodiments.
Figure 2:
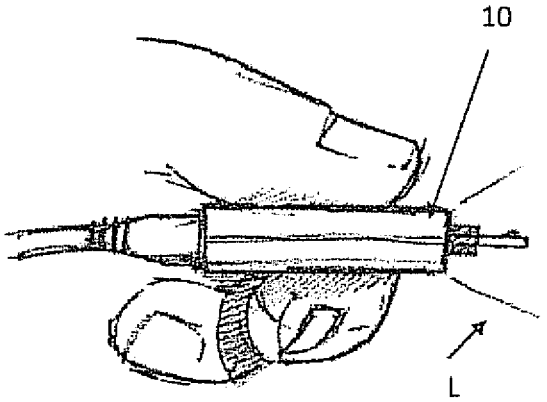
FIG. 2 is a side view of the charging connection device being operated in accordance with features of the present embodiments.
Figure 3:
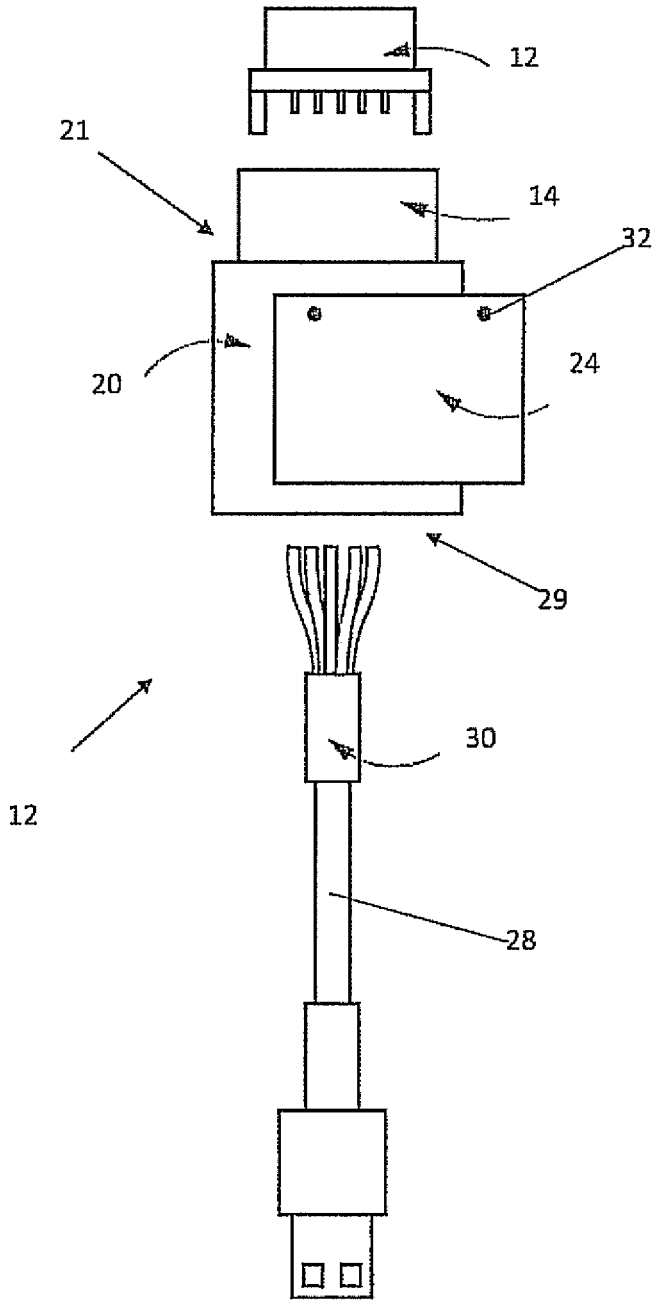
FIG. 3 is a schematic exploded view of the charging connection device in accordance with features of the present embodiments.
Figure 4:
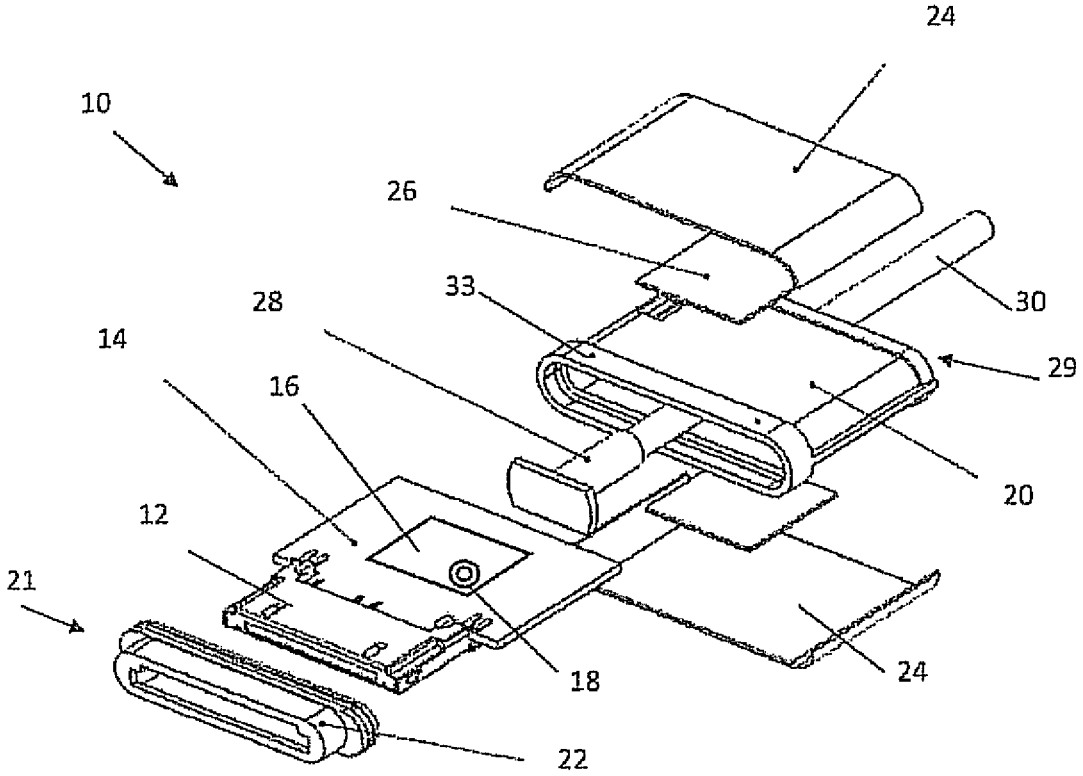
FIG. 4 is an exploded plan view of an embodiment of the charging connection device of the present invention.
Figure 5:
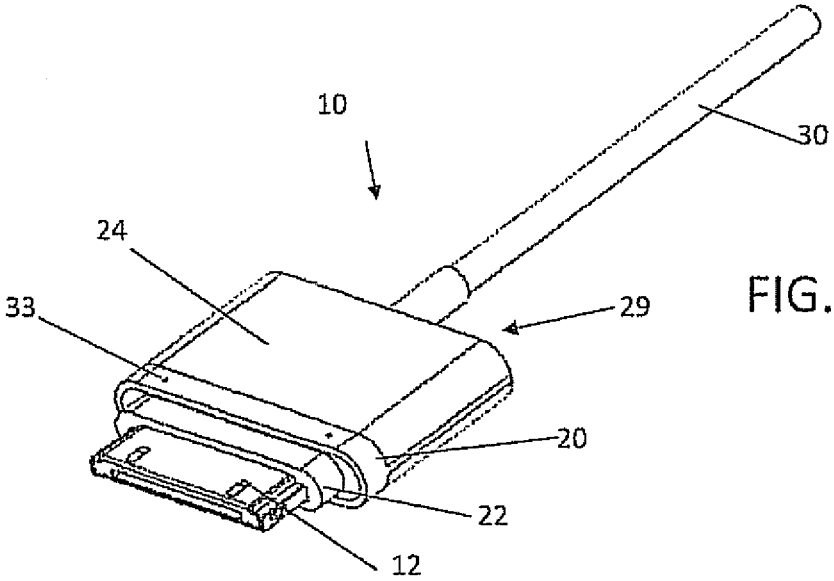
FIG. 5 is a schematic plan view of the charging connection device of FIG. 4.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring initially to FIGS. 1-5, a charging connection device 10 in accordance with features of the present invention will be described. The charging connection device 10 provides directed illumination or light L while a user is trying to charge or sync their mobile device MD, which makes plugging it in, while its dark, much easier.

The charging connection device 10 includes a device connector 12 configured to be coupled to a rechargeable electronic device, such as mobile device MD or any other portable electronic device including a rechargeable battery. The device connector 12 is typically a male connector, for example, a micro USB or Apple 30-pin connector. A circuit board 14 is coupled to the device connector 12 and includes charging circuitry 16 and an associated light source 18, such as one or more light emitting diodes (LEDs), thereon. Electrical wiring may be used instead to connect the circuitry, LEDs, device connector etc.

A housing 20 encloses the circuit board 14 and includes a first end 21 comprising a lens 22, with the device connector 12 extending from the first end. The housing 20 is formed of a non-conductive material, such as molded plastic. The lens 22 passes or directs light L from the light source 18 in the direction that the device connector 12 is being pointed.

The lens 22 may be a portion of the first end 21 or may define the entire first end 21 as illustrated. Also, the lens 22 may be glass or transparent plastic, for example, and is at least partially transparent, and may be refractive if desired. The lens 22 could also be an opening in the first end 21.

To activate the light source 18, an uncomplicated switch is provided. Many users typically leave their charging cables continuously plugged into a power source, such as a wall outlet. Thus, it is preferable to be able to selectively activate the light source 18 to conserve energy and avoid unwanted light, e.g. when sleeping. In this embodiment, a touch-type switch is carried by the housing 20, such as touch plates 24 on opposite sides of the housing 20, electrically coupled to the circuit board, and configured to activate the light source 18. An adhesive 26 may secure the touch plates 24 and the housing 20.

The touch plates 24, coupled to associated circuitry on the circuit board 14, define a touch-type switch, for example a resistance touch switch which needs two electrodes to be in physical contact with something electrically conductive (for example, finger(s) of the user) to operate. The fingers of the user lower the resistance between the touch plates 24, such as two pieces of metal. Placing one or two fingers across the touch plates 24 achieves a turn on or closed state. Removing the finger(s) from the touch plates 24 turns the light source 18 off. A capacitance touch switch or touch chip-type switch could also be used, as would be appreciated by those skilled in the art.

A power source connector 28 is coupled to the circuit board 14 and associated with a second end 29 of the housing 20. The power source connector 28 may be a charging cable 30, such as a Universal Serial Bus (USB) cable with a USB type-A connector at the distal end thereof.

One of the touch plates 24 may include at least one opening 32 (e.g. FIG. 3) therein to transmit light from the light source 18 and indicate right-side-up for the device connector 12. Additionally or alternatively, one side of the housing 20 may include such an opening(s) 33.

A method of making a charging connection device 10 is also described. The method includes coupling a device connector 12, configured to be coupled to a rechargeable electronic device ND, to a circuit board 14 that includes charging circuitry 16 and an associated light source 18 thereon. The method also includes enclosing the circuit board 14 with a housing 20 that includes a first end 21 comprising a lens 22. The device connector 12 extends from the first end 21 of the housing 20. Touch plates 24 are provided on opposite sides of the housing 20 and coupled to the circuit board 14, and configured to activate the light source 18. The method includes coupling a power source connector 28 to the circuit board 14 and associated with a second end 29 of the housing 20.

Figure 6:
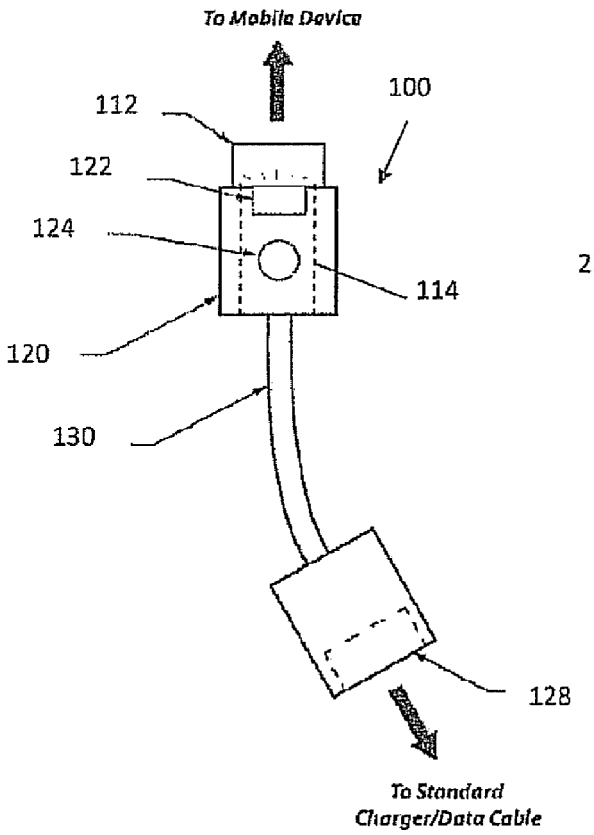
FIGS. 6 and 7 are schematic diagrams illustrating various alternative embodiments of the charging connection device.
Figure 7:
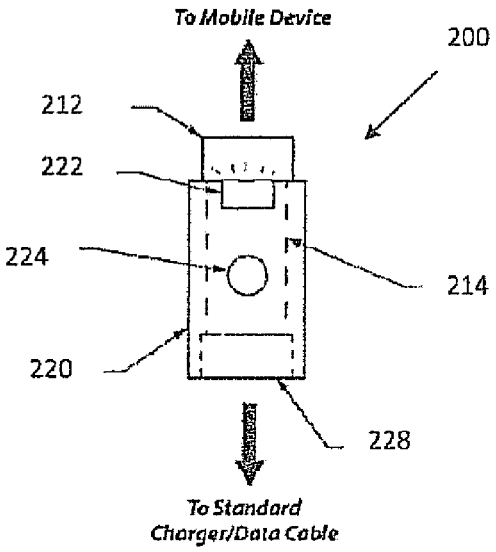

In other embodiments, as illustrated in FIGS. 6 and 7, the charging connection device 100/200 may be defined as an adapter for an existing charging/data cable. The charging connection device 100/200 includes device connector 112/212, circuit board 114/214, housing 120/220, and lens 122/222. A switch 124/224 is illustrated as a push button switch, for example. The power source connector 128/228 is a female connector configured to receive a power charging cable (not shown). As illustrated in FIG. 6, a cable 130 may couple the power source connector 128 to the circuit board 114.

The present embodiments provide directed illumination while the user is trying to charge or sync their mobile device, which makes plugging it in, while it is dark, much easier. The illumination is activated when the touch plates are touched to provide an uncomplicated intuitive product for the customer. In essence, the user does not need to think about activating the illumination. They grab the end of the cable, and it lights up, providing the right amount of light to find the device's charger port and at the same time, know that the connector is right side up.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

The invention claimed is:

1. A charging connection device comprising:

a device connector configured to be coupled to a rechargeable electronic device;

a circuit board coupled to the connector and including charging circuitry and an associated light source thereon;

a housing enclosing the circuit board and including a first end comprising a lens, the connector extending from the first end, and one side of the housing including at least one opening therein to transmit light from the light source and indicate right-side-up;

a touch switch carried by the housing, coupled to the circuit board, and configured to activate the light source; and a power source connector coupled to the circuit board and associated with a second end of the housing.

2. The charging connection device according to claim 1, wherein the touch switch comprises touch plates on opposite sides of the housing, coupled to the circuit board, and configured to activate the light source.

3. The charging connection device according to claim 2, wherein one of the touch plates includes at least one opening therein to transmit light from the light source and indicate right-side-up.

4. The charging connection device according to claim 1, wherein the light source comprises a light emitting diode (LED).

5. The charging connection device according to claim 1, wherein the power source connector comprises a female connector configured to receive a power charging cable.

6. The charging connection device according to claim 1, further comprising a charging cable coupling the power source connector to the circuit board.

7. The charging connection device according to claim 6, wherein the charging cable comprises a Universal Serial Bus (USB) cable.

8. A charging connection device comprising:

a device connector configured to be coupled to a rechargeable electronic device;

a circuit board coupled to the connector and including charging circuitry and an associated light emitting diode (LED) thereon;

a housing enclosing the circuit board and including a first end comprising a lens, the connector extending from the first end;

touch plates on opposite sides of the housing, coupled to the circuit board, and configured to activate the LED; and a charging cable coupled to the circuit board and extending from a second end of the housing.

9. The charging connection device according to claim 8, wherein one of the touch plates includes at least one opening therein to transmit light from the light source and indicate right-side-up.

10. The charging connection device according to claim 8, wherein one side of the housing includes at least one opening therein to transmit light from the light source and indicate right-side-up.

11. The charging connection device according to claim 8, further comprising an adhesive between the touch plates and the housing.

12. The charging connection device according to claim 8, further comprising a power source connector at a distal end of the charging cable.

13. The charging connection device according to claim 8, wherein the charging cable comprises a Universal Serial Bus (USB) cable.

14. A charging connection device comprising:

a device connector configured to be coupled to a rechargeable electronic device;

a circuit board coupled to the connector and including charging circuitry and an associated light source thereon;

a housing enclosing the circuit board and including a first end comprising a lens, the connector extending from the first end;

a touch switch carried by the housing, and comprising touch plates on opposite sides of the housing coupled to the circuit board, and configured to activate the light source; and a power source connector coupled to the circuit board and associated with a second end of the housing.

15. The charging connection device according to claim 14, wherein the light source comprises a light emitting diode (LED).

16. The charging connection device according to claim 14, wherein the power source connector comprises a female connector configured to receive a power charging cable.

17. The charging connection device according to claim 14, further comprising a charging cable coupling the power source connector to the circuit board.

18. The charging connection device according to claim 17, wherein the charging cable comprises a Universal Serial Bus (USB) cable.

* * * * *